US006515585B2

(12) United States Patent
Yamamoto

(10) Patent No.: US 6,515,585 B2
(45) Date of Patent: Feb. 4, 2003

(54) REMINDER SYSTEM

(75) Inventor: Yoshinobu Yamamoto, Tokyo (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 0 days.

(21) Appl. No.: 09/748,252

(22) Filed: Dec. 27, 2000

(65) Prior Publication Data

US 2001/0007441 A1 Jul. 12, 2001

(30) Foreign Application Priority Data

Jan. 6, 2000 (JP) ..... 2000-000660

(51) Int. Cl.[7] ..... G08B 7/00

(52) U.S. Cl. ..... 340/539; 340/988; 340/990; 340/457; 340/457.1; 340/457.2; 340/457.3; 340/457.4

(58) Field of Search ..... 340/988, 990, 340/995, 996, 905, 539, 457, 457.1, 457.2, 457.3, 457.4

(56) References Cited

U.S. PATENT DOCUMENTS 5,379,451 A * 1/1995 Nakagoshi et al. ..... 455/54.2
6,091,956 A * 7/2000 Hollengerg ..... 455/456
6,097,313 A * 8/2000 Takahashi et al. ..... 340/905
6,144,318 A * 11/2000 Hayashi et al. ..... 340/995

* cited by examiner

*Primary Examiner*—Daniel J. Wu
*Assistant Examiner*—Daniel Previl
(74) *Attorney, Agent, or Firm*—Robert J. Frank; Chad C. Anderson; Venable

(57) ABSTRACT

A reminder system operating at a specified location is provided. When an information ID (such as an "address C, B, AA, and bookstore") transmitted from a small antenna station agrees with information (such as an "address C, B, AA, and bookstore") stored in a memory of a reminder passing by the installation location of the small antenna station, the reminder outputs an alarm, and displays free messages ("The address here is C, B, AA" and "There is a bookstore") on the display of the reminder. Thus, a user carrying the reminder is alerted to the business input in advance to the reminder.

11 Claims, 4 Drawing Sheets

REMINDER SYSTEM

This application is based on patent application Ser. No. 2000-660 filed Jan. 6, 2000 in Japan, the content of which is incorporated hereinto by reference.

BACKGROUND OF THE INVENTION

1. Field of the Invention

The present invention relates to a reminder system that functions as a reminder of a prescribed location.

2. Description of Related Art

A reminder is known as a device that reminds a user of the schedule. For example, to make a phone call at three o'clock, the user not only writes the "phone call" into a scheduler, but also enters the time into a reminder so that the reminder is activated (sounds an alarm) at three o'clock to remind the user of the phone call by beeping. Thus, the conventional reminder can record the time to remind the user of a business.

In contrast, assume that the user was going to the office with a postcard to be mailed at a mailbox on the way, but forgot to mail it although he or she had passed by the mailbox. In such a case, the reminder is inapplicable because its function is to record the time to sound a warning for some business. In other words, a particular place (the neighborhood of the mailbox in the this example) cannot be set to sound the warning beep.

SUMMARY OF THE INVENTION

The present invention is implemented to solve the foregoing problem. It is therefore an object of the present invention to provide a reminder system capable of reminding a user of a particular place.

According to a first aspect of the present invention, there is provided a mobile information terminal comprising: a terminal-side memory for storing spatial information about a specified location; a terminal-side receiver for receiving a radio signal with a first predetermined frequency; decision means for making a decision as to whether information in the signal received by the terminal-side receiver agrees with the spatial information in the terminal-side memory; and output means for outputting notification information to a person equipped with the mobile information terminal when the decision of said decision means indicates agreement, the notification information including at least one of sound information and vibration information which indicate that a location of the person equipped with the mobile information terminal corresponds to the specified location.

According to a second aspect of the present invention, there is provided an antenna station installed at a specified location, the antenna station comprising: a station-side memory for storing spatial information about the specified location; and a station-side transmitter for transmitting the spatial information in the station-side memory to the specified location by a radio wave with a first predetermined frequency.

According to a third aspect of the present invention, there is provided a reminder system comprising a mobile information terminal, and an antenna station installed at a specified location, the mobile information terminal comprising:

a terminal-side memory for storing spatial information about the specified location;

a terminal-side receiver for receiving a radio signal with a first predetermined frequency;

decision means for making a decision as to whether information in the signal received by the terminal-side receiver agrees with the spatial information in the terminal-side memory; and output means for outputting notification information to a person equipped with the mobile information terminal when the decision of the decision means indicates agreement, the notification information and vibration information which indicating that a location of the person equipped with the mobile information terminal corresponds to the specified location, and the antenna station comprising:

a station-side memory for storing spatial information about the specified location; and a station-side transmitter for transmitting the spatial information in the station-side memory to the specified location by a radio wave with the first predetermined frequency.

According to a fourth aspect of the present invention, there is provided a reminder system comprising a mobile information terminal, an antenna station installed at a specified location, and a information managing server, the mobile information terminal comprising:

a terminal-side memory for storing spatial information about the specified location;

a terminal-side receiver for receiving a radio signal with a first predetermined frequency;

decision means for making a decision as to whether information in the signal received by the terminal-side receiver agrees with the spatial information in the terminal-side memory; and output means for outputting notification information to a person equipped with the mobile information terminal when the decision of the decision means indicates agreement, the notification information including at least one of sound information and vibration information which indicate that a location of the person equipped with the mobile information terminal corresponds to the specified location, said antenna station comprising:

a station-side memory for storing spatial information about the specified location; and a station-side transmitter for transmitting the spatial information in the station-side memory to the specified location by a radio wave with the first predetermined frequency, and the information managing server comprising:

server-side communicating means connected to a communication network to carry out communication with at least one of the mobile information terminal and the antenna station;

a database that stores at least information on the specified location; and a server-side controller for controlling information transfer between the server-side communicating means and the database.

Here, the mobile information terminal may further comprise a terminal-side display. The notification information further includes display information to be displayed on the terminal-side display.

The mobile information terminal may further comprise terminal-side input means for inputting prescribed setting information; the terminal-side memory may store the prescribed setting information supplied from the terminal-side input means; and the decision means may make a decision as to whether the information in the signal received by the terminal-side receiver agrees with the prescribed spatial information and the setting information in the terminal-side memory.

The mobile information terminal may further comprise a timer; and the decision means may refer to time information fed from the timer when the prescribed setting information is information about time.

The mobile information terminal may further comprise: terminal-side communicating means connected to a communication network for carrying out communication; and a terminal-side controller for controlling information transfer between the terminal-side communicating means and the terminal-side memory.

The mobile information terminal may further comprise a terminal-side transmitter for transmitting a response signal by a radio wave with a second predetermined frequency when the decision of the decision means indicates agreement.

The antenna station may further comprise station-side input means for inputting prescribed setting information; the station-side memory may store the prescribed setting information fed from the station-side input means; and the station-side transmitter may transmit the information about the specified location and prescribed setting information in the station-side memory by a radio wave with the first predetermined frequency.

The antenna station may further comprise: station-side communicating means connected to a communication network for carrying out communication; and a station-side controller for controlling information transfer between the station-side communicating means and the station-side memory.

The antenna station may further comprise: a station-side receiver for receiving a radio wave with a second predetermined frequency; and a station-side display for displaying information in response to a signal received by the station-side receiver.

The database may further store prescribed setting information.

The server-side controller may limit information to be transmitted to the server-side communicating means as needed.

The above and other objects, features and advantages of the present invention will become more apparent from the following description of embodiments thereof taken in conjunction with the accompanying drawings.

DETAILED DESCRIPTION OF THE PREFERRED EMBODIMENT

The invention will now be described with reference to the accompanying drawings.

Figure 1:
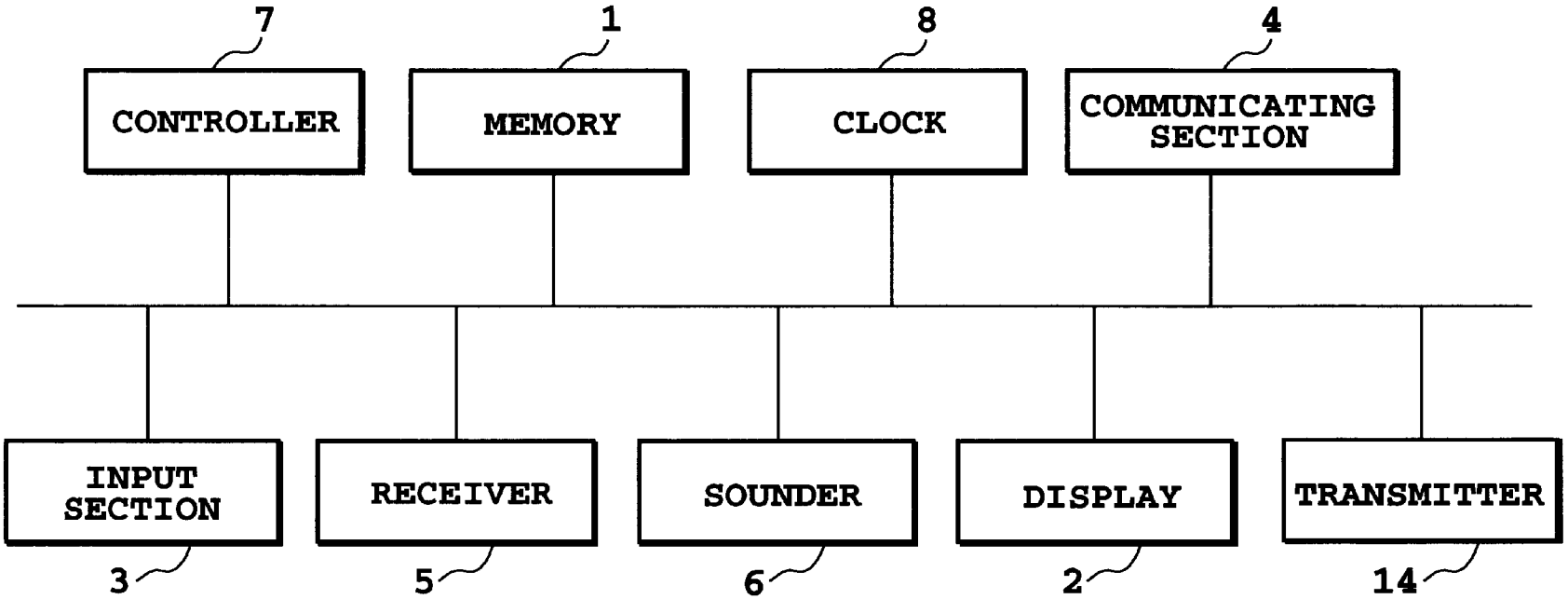
FIG. 1 is a block diagram showing a configuration of a reminder of an embodiment in accordance with the present invention.
Figure 2:
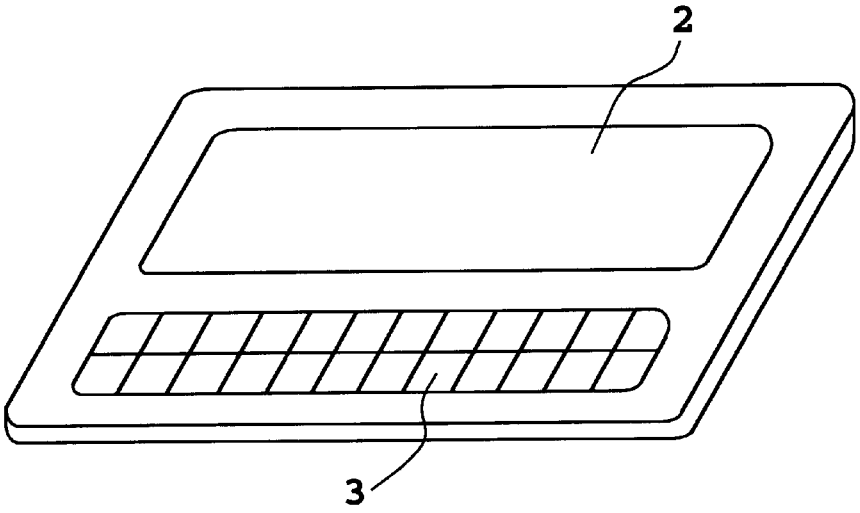
FIG. 2 is an external view of the reminder.

FIG. 1 is a block diagram showing a configuration of a reminder as a mobile station in accordance with the present invention; and FIG. 2 is an external view of the reminder.

In FIG. 1, the reference numeral 1 designates a memory for storing a user ID and other information; 2 designates a display such as a liquid crystal display and 3 designates an input section including a keypad (and a microphone for voice input, if necessary), which are provided for carrying out interaction with a user; 4 designates a communication section for carrying out communication with an information managing server which will be described later by making connection with the Internet environment; 5 designates a receiver for receiving a radio wave of a particular frequency and for extracting necessary information by demodulating (decoding) the received signal; and 6 designates a sounder for generating a particular electronic sound or a synthesized sound in response to an input signal (the sounder can be replaced with a vibrator). The reference numeral 14 designates a transmitter provided as needed, which includes an antenna for transmitting a response signal consisting of a faint radio wave. The antenna is installed inside the casing of the reminder as shown in FIG. 2. The reference numerals 7 and 8 designate a controller and a clock, respectively, for controlling the foregoing components. All the components use a battery (not shown) as their power supply. The controller 7 comprises a CPU and a system memory. The CPU controls the entire operation of the reminder in accordance with programs stored in the system memory (and referring to the time data of the clock 8 as needed). Although the details will be described later, the controller 7 activates the sounder 6 when the information in the memory 1 agrees with the information extracted by the receiver 5 from the received signal, and drives the display 2 to display information, and the transmitter 14 to transmit the response signal as needed. The response signal can be any type of signal that is receivable by the signal processor of a small antenna station which will be described later, and that can provide the display of the small antenna station with the timing to display information. The response signal can include the foregoing information in the memory 1 that agrees with the information extracted from the received signal by the receiver 5, and the user ID if necessary.

Figure 3:
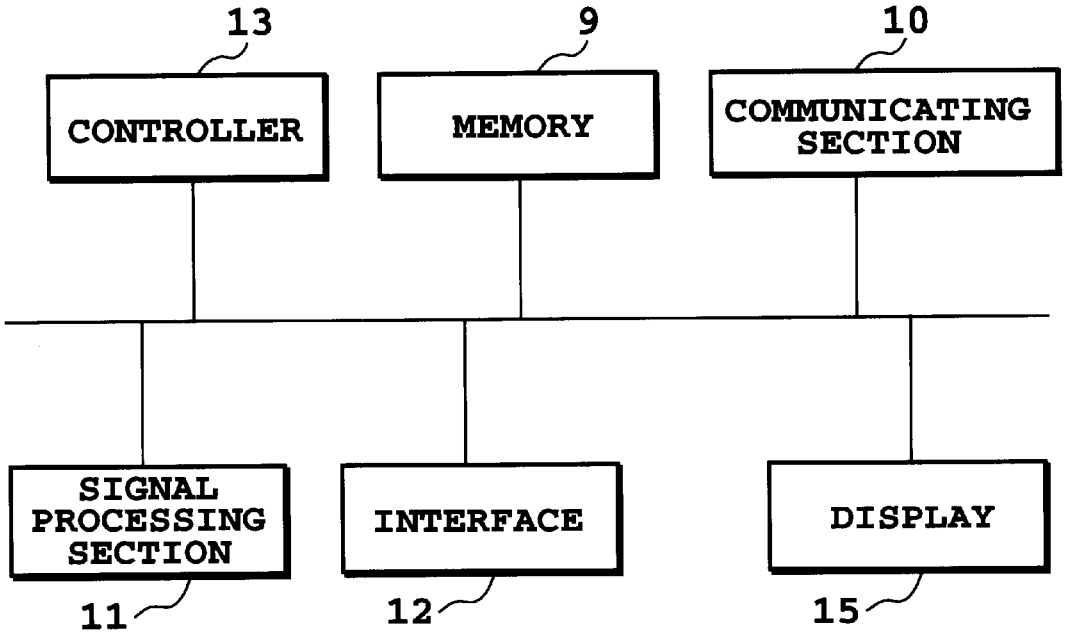
FIG. 3 is a block diagram showing a configuration of a small antenna station of the embodiment in accordance with the present invention.

FIG. 3 is a block diagram of the small antenna station. In FIG. 3, the reference numeral 9 designates a memory for storing an ID proper to the antenna station (antenna ID) together with other information; and 10 designates a communication section for communicating through the Internet with an information managing server which will be described later. The reference numeral 11 designates a signal processor that includes an antenna for radiating a faint radio wave to transmit a radio signal within a limited range, and for receiving a necessary radio signal as needed. The reference numeral 12 designates an interface for inputting various items of information such as information on the installer of the small antenna station, information on the installed location, information that is set, etc.; and 13 designates the controller for controlling the foregoing components. The signal processing section 11 transmits a radio signal bearing the information in the memory 9, and receives the response signal from the above-mentioned reminder as needed. The information in the memory 9 is transmitted from the signal processing section 11 periodically.

The reference numeral 15 designates a display for displaying the necessary information according to the response signal received by the signal processing section 11. The display 15 can be installed at a place separated from the small antenna station, and the number of the display is not limited to one. As will be described later, the purpose of the information exhibited on the display 15 is to notify the user carrying the reminder of that information. Thus, the information shown on the display 15 may be various kinds of information such as those contained in the response signal, indicating the location of the small antenna station, and predetermined in the memory 9 of the small antenna station. As for the display mode of the display 15, it can display only text information, or text information with additional flashing light and/or sound information.

The controller 13 comprises a CPU and a system memory, and controls the entire small antenna station in accordance with programs in the system memory.

The small antenna station with the foregoing configuration is installed in a particular place (the details of which will be described later).

Figure 5:
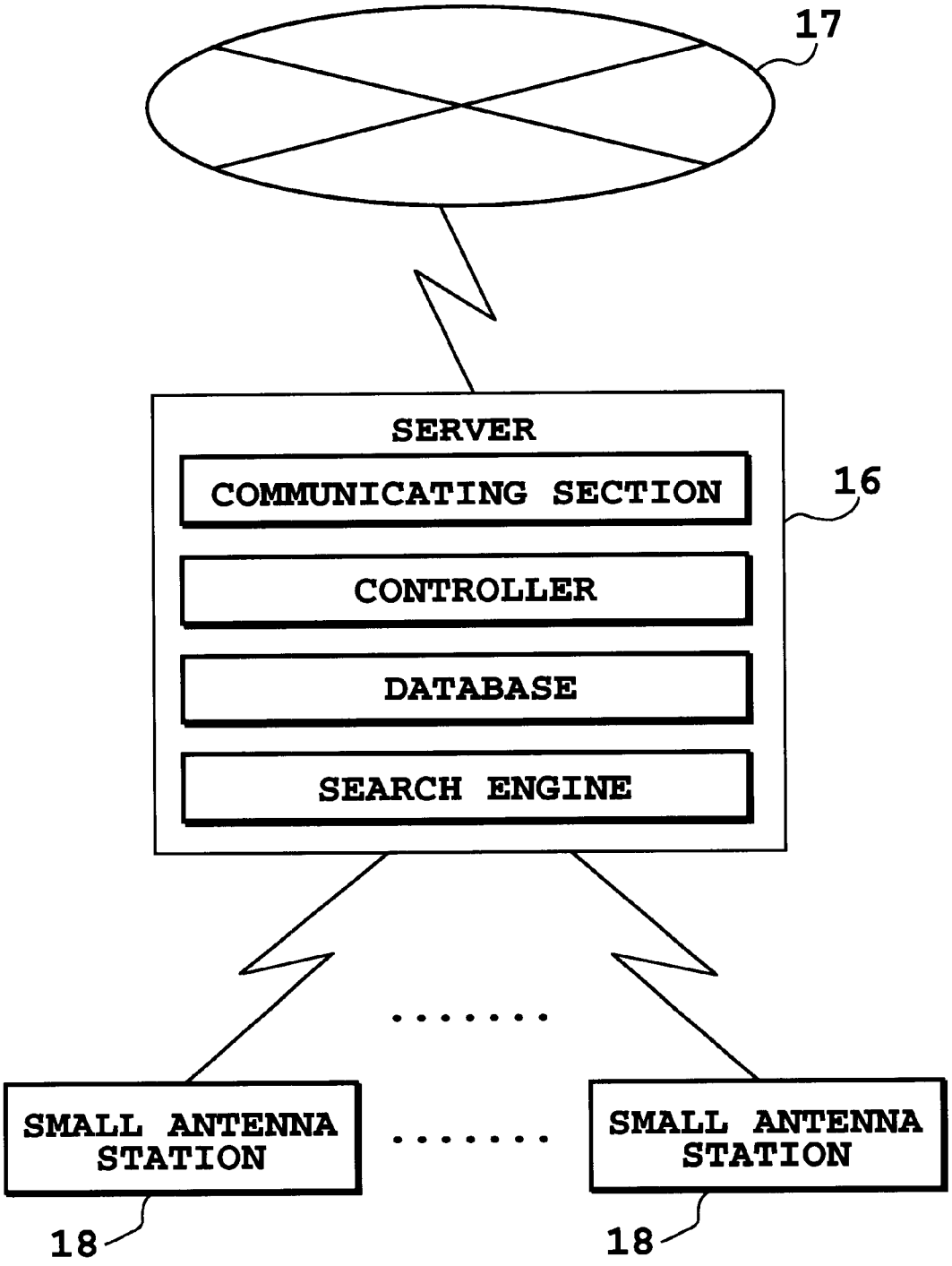
FIG. 5 is a block diagram showing relationships between an information managing server, the Internet and the small antenna station.

As shown in FIG. 5, the information managing server 16 comprises a communication section for establishing connection with the Internet 17; a database for managing information stored in the memory of the small antenna stations installed in particular locations (including information on headers and free messages which will be described later) and the like; a search engine for carrying out fuzzy search using information in the database (the search for neighboring information or using abstract keywords); and a controller for controlling them. The information managing server can be configured using a computer system with a communication function.

Figure 4:
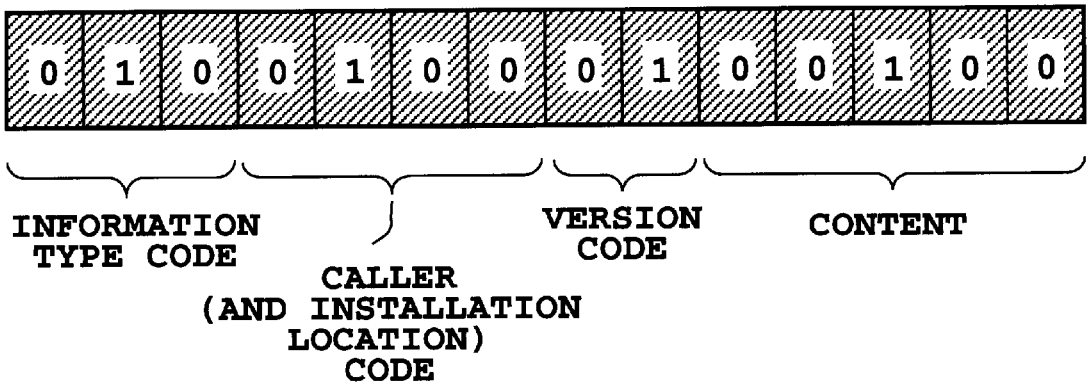
FIG. 4 is a schematic diagram showing a structure of information ID transmitted from the small antenna station.

In the foregoing configuration, the information that is stored in the memory 9 in the small antenna station and transmitted periodically from the signal processing section 11, consists of a pair of a header and a free message. The header consists of an ID (number) for roughly dividing the content of the free message. The ID is set and managed by the information managing server, and can be added or corrected afterward. FIG. 4 shows an example of the ID. As shown in FIG. 4, the ID consists of an information type code, a caller (and/or installation location) code, a version code and a content. The information type code includes, for example, information for identifying the location of the antenna station (that is, the installation location information), or information for identifying a particular service provided in the neighborhood of that site (these are only examples, and the information is not limited to these). The caller (and installation location) code consists of information for identifying the caller and/or installation location. The version code consists of information for identifying the version of the code system, and the content represents the content of the information specified by the information type code. The free message consists of the message corresponding to the content. Examples of the content are as follows. The content of the installation location information consists of an address such as "XX, YY, ZZ" (house number, street address and town name), and that of the service information consists of "bookstore", "post office", "ATM" (Automated Teller Machine) and the like, and examples of the free messages corresponding to them are "The address here is XX, YY, ZZ", "There is a bookstore", "You can mail here", and "There is an ATM".

Such information items stored in the memory 9 are selected in accordance with the location of the small antenna station and the service it provides, and the selected information is periodically transmitted from the signal processing section 11.

On the other hand, a user inputs necessary information to the reminder by selecting an item in a menu shown on the display 2, or by inputting letters or voices from the input section 3 to store the input information in the memory 1. The necessary information corresponds to the information transmitted from the small antenna station, representing information type, caller (and installation location), version and content. As for the caller (and installation location) and version, it is not always necessary to input them, in which case, only the information input is used for matching).

An example of an actual operation will be described. For example, the user selects position information from the displayed menu as the information type, and inputs an address "C, B, AA" (house number, street address and town name) as the content. Thus, the memory 1 stores the position information as the information type, and the address "C, B, AA" as the corresponding content. In addition, the user selects the service information from the displayed menu as the information type, and inputs the word "bookstore" as the content, for example. Thus, the memory 1 stores the service information as the information type, and the word "bookstore" as the corresponding content.

On the other hand, the memory 9 of the small antenna station installed at the address C, B, AA stores corresponding information as its transmission information ID. Specifically, it stores the information type code consisting of the position information and the corresponding content consisting of the address "C, B, AA", and the information type code consisting of the service information and the corresponding content consisting of the "bookstore". Accordingly, when the user having the reminder passes by the address C, B, AA, the receiver 5 of the reminder receives the radio signal from the small antenna station including the transmission information ID so that the reminder makes a decision as to whether the information extracted from the received signal agrees with the information stored in the memory 1 of the reminder. Since they agree in this case, the controller 7 in the reminder drives the sounder 6 to produce a warning beep, and the display 2 to show the free message ("The address here is "C, B, AA", and "There is a bookstore") corresponding to the information types (position information and service information). Furthermore, when necessary, the transmitter 14 of the reminder sends the response signal, and the signal processing section 11 of the small antenna station receives it to display the necessary information on its display 15. As a result, the user carrying the reminder is alerted to the input business. Besides, the user can more positively alerted by watching the display information on the display 15.

Incidentally, the user can also input time information (time and date or a time period enabling the alarm) into in the memory 1 of the reminder so that the time information is managed only by the reminder. The controller 7 in the reminder that approaches the installation location can utilize the time information in such a manner that even if the information ID transmitted from the small antenna station agrees with the information in the memory 1 of the reminder as described above, the controller 7 refers to the time data of the clock 8, and enables the reminder only when the time information in the memory 1 agrees with the time data.

The foregoing description is an example of a fundamental operation of the reminder. In brief, its basic operation is to produce the notification information such as an alarm only when the information ID transmitted from the small antenna station at the installation location agrees with the information in the memory 1 of the remainder that comes into the area of the installation location. In addition, the necessary information can be displayed on the display 15 of the small antenna station.

As the information ID transmitted from the small antenna station, various types of information in a very wide range can be set as will be described later. Besides, the addition or change of the information can be made by the information managing server through the Internet.

For example, the reminder, which includes the name of a particular store input in advance as the service information, can make a decision when the alarm sounds that "there is a store which accepts my coupons". To achieve this using the positioning service of a PHS (Personal Handyphone System), a switching system of the PHS must capture the ID of a receiver in the neighborhood of the particular store, and transmits the advertisement information to the receiver with that ID. In contrast with this, the present invention can simplify the configuration of the receiver (reminder), offering an advantage of being able to save power and keep privacy when a transmitter is not provided on the receiver side. Furthermore, the reminder can be used in hospitals because it utilizes only very faint radio waves. In the hospitals, since the reminder can locate its own position, a patient carrying it can decide the right way to take by only watching its display.

The small antenna stations enable their users to make advertisement by transmitting service information. Alternatively, for the purpose of coping with the concentration of the antenna stations or of facilitating their maintenance, they can carry out regular communications with an information managing server installed on the Internet. The information managing server can also supervise or regulate whether the small antenna stations update their information appropriately, or transmit information disadvantageous for consumers. The information managing server can comprise a means for not authorizing particular small antenna stations (or limiting their data transmission).

Users can receive a list of latest information IDs from the information managing server by connecting their reminders to the Internet via the communication section 4. At the same time, they can obtain the latest information about add-on small antenna stations. Furthermore, they can obtain information on small antenna stations distant from themselves by connecting their reminders to the Internet.

Application of the Reminder System

The present system can be used in various ways. The following methods can be used singly or in combination.

1. Application as a Private Navigation System.

The reminder system is applicable as a private navigation for a user to search for the way to a desired shop or a restaurant with a favorite menu, for the closest rest room, or for a stray friend, by inputting relevant information into the reminder.

2. Application to Hospitals.

Patients subjected to an X-ray or MRI (Magnetic Resonance Imager) must usually move in a hospital, and often lose their ways, causing one of their complaints. In addition, the cost for the guide is not negligible. The remainder system of the present invention is applicable to such situations. For example, the hospital can provide a convenience for the patients by installing the small antenna stations at corners and crossings of a hospital corridor and at a medical office window with displays if necessary, and by having the patients carry the reminders. Furthermore, the present system can provide the patients with relevant medical information through their reminders, or can call them, in which case, the necessary information can be displayed on the displays of the small antenna stations.

3. Application to Amusement Parks.

Since the present system can always update its information and transmits it from the small antenna stations, it serves for searching for attractions enjoyable sooner or available rest rooms by watching the display of the remainder.

4. Application to Department Stores or Shopping Streets.

Since storekeepers can update information to be transmitted from their small antenna stations, the reminders of the present system can directly provide consumers with such information as time-limited services which they cannot enjoy before with conventional electronic media. Besides, the information can be directly transmitted to the consumers through the displays of the small antenna stations as needed.

5. Application to Art Galleries or Museums.

Displays in an art gallery or museum are optimally arranged to fit its structure according to a theme determined by a curator. For example, assume that the displays are japan wares and the theme prepared by the curator is "japan wares and local industry". In this case, some spectators may be interested in "japan wares considered in relation to Japanese history" or "japan wares from the standpoint of Mr. So and so, an art critic". Other spectators may want to proceed not along the usual route, but along a route according to the theme they select by themselves. In such cases, they can enjoy the exhibition more by inputting the themes they select into their reminders to display necessary information on the displays of the small antenna stations. Thus, the utilization of the present system can lead some spectators to visit the same exhibition repeatedly.

6. Application to Tourist Resorts as a Tour Conductor.

The reminder system is applicable as a tour conductor because it enables guidance in a tourist resort. To travel only a usual route will spoil one of the pleasures of the tour, that is, "unexpected happenings". The present reminder system can provide tourists with unexpected information on the spots, offering the "unexpected happenings" such as enjoying a play, visiting souvenir shops, and the like.

7. Application to Games and Stamp Rallies.

The present reminder system can implement various games using such information as can be obtained only at special locations. Placing prescribed information in the reminder system makes it possible to plan games involving searching for places to visit next, or games using information transmitted at particular timings. In addition, games are possible that enable only particular reminder systems to decode information. For example, it is possible to set such conditions as enabling only the reminders to decode the information at a particular site only after correctly answering a quiz, or to decode the information at the next point only when proceeding a specified route.

8. Application to Subways.

The present reminder system can be used in subways for indicating shortest paths for changing lines, or for navigating in unexpected disasters. In such cases, the displays in the small antenna stations can show necessary information. The present system employing the small antenna stations is applicable in subway spaces.

9. Application to Bus Stops.

Since the small antenna station of the present reminder system can transmit local bus-run information, a passenger can learn waiting time for the bus. Integrating the reminder with a commuter pass can provide more intelligent services.

10. Application to Coupons.

As to coupons distributed as newspaper insertions and the like, although a few diligent persons will clip and bring them about, many do not. In contrast, coupon service using the present reminder system can distribute coupons by radio so that the reminder can respond in front of a shop accepting the coupons. In this case, the small antenna station can display the necessary information on its display unit.

11. Application to Finding a Thing Left Behind by Recording a Way a User Took.

The reminder of the present reminder system can record information about the spots on the way the user took by storing position information into its memory every time it receives radio waves from the small antenna stations. The record will serve to find a thing left behind, or to write diary afterward.

12. Application to Locks

Applying the reminder of the present reminder system as a lock enables the reminder to open at a particular place at which the specified small antenna station is installed. Thus, an article can be carried more safely to the destination.

13. Application as a Position Detector.

The reminder of the present reminder system can be used as a reliable, safe and cheap position detector available even inside a house by receiving signals from a plurality of small antenna stations. In this case, the small antenna stations can display the necessary information on the display units.

As described above, according to the present invention, a spatial reminder can be implemented positively.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A reminder system comprising a mobile information terminal, and an antenna station installed at a specified location, said mobile information terminal comprising:

a terminal-side memory for storing setting information about the specified location;

a terminal-side receiver for receiving a radio signal with a first predetermined frequency;

decision means for making a decision as to whether information in the signal received by said terminal-side receiver agrees with the setting information in said terminal-side memory;

output means for outputting notification information to a person equipped with the mobile information terminal when the decision of said decision means indicates agreement, the notification information including at least one of sound information and vibration information, the notification information indicating as a reminder that a location of the person equipped with the mobile information terminal corresponds to the specified location;

terminal-side input means for inputting prescribed setting information to be set in the terminal-side memory; and a terminal-side transmitter for transmitting a response signal by a radio wave with a second predetermined frequency when the decision of said decision means indicates agreement, the response signal being based on the setting information in the terminal-side memory, and said antenna station comprising:

a station-side memory for storing settings information about the specified location;

a station-side transmitter for transmitting the setting information in said station-side memory to region surrounding the specified location by a radio wave with the first predetermined frequency;

station-side input means for inputting prescribed setting information to be set in the station-side memory;

a station-side receiver for receiving the radio wave with the second predetermined frequency; and a station-side display for displaying information based on the response signal received by said station-side receiver.

2. The reminder system as claimed in claim 1, wherein said output means further comprises a terminal-side display; and said notification information further includes display information to be displayed on the terminal-side display.

3. The reminder system as claimed in claim 1, wherein said mobile information terminal further comprises a timer; and said decision means refers to time information fed from said timer when the prescribed setting information in the terminal-side memory is information about time.

4. The reminder system as claimed in claim 1, wherein said mobile information terminal further comprises:

terminal-side communicating means connected to a communication network for carrying out communication; and a terminal-side controller for controlling information transfer between said terminal-side communicating means and said terminal-side memory.

5. The reminder system as claimed in claim 1, wherein said antenna station further comprises:

station-side communicating means connected to a communication network for carrying out communication; and a station-side controller for controlling information transfer between said station-side communicating means and said station-side memory.

6. The reminder system as claimed in claim 1, further comprising a information managing server, said information managing server comprising:

server-side communicating means connected to a communication network to carry out communication with at least one of the mobile information terminal and the antenna station;

a database that stores at least setting information on the specified location; and a server-side controller for controlling information transfer between said server-side communicating means and said database.

7. The reminder system as claimed in claim 6, wherein said output means further comprises a terminal-side display; and said notification information further includes display information to be displayed on the terminal-side display.

8. The reminder system as claimed in claim 6, wherein said mobile information terminal further comprises a timer; and said decision means refers to time information fed from said timer when the prescribed setting information in the terminal-side memory is information about time.

9. The reminder system as claimed in claim 6, wherein said mobile information terminal further comprises:

terminal-side communicating means connected to a communication network for carrying out communication; and a terminal-side controller for controlling information transfer between said terminal-side communicating means and said terminal-side memory.

10. The reminder system as claimed in claim 6, wherein said antenna station further comprises:

station-side communicating means connected to a communication network for carrying out communication; and a station-side controller for controlling information transfer between said station-side communicating means and said station-side memory.

11. The reminder system as claimed in claim 6, wherein said server-side controller limits information to be transmitted to said server-side communicating means as needed.

* * * * *